United States Patent [19]

Chave

[11] 4,061,433

[45] Dec. 6, 1977

[54] EXTENSION ROD FOR PERCUSSIVE DRILLING TOOL

[75] Inventor: Henri Chave, Bourg en Bresse, France

[73] Assignee: Ugine Aciers, Paris, France

[21] Appl. No.: 707,020

[22] Filed: July 20, 1976

[30] Foreign Application Priority Data

Aug. 13, 1975 France ..... 75.25708

[51] Int. Cl.[2] ..... F16B 7/04

[52] U.S. Cl. ..... 403/359; 89/16

[58] Field of Search ..... 403/359; 173/131; 175/320; 64/1 S; 138/38, 127, 172, 148; 89/16; 42/76 R, 76 A; 285/114, 333, 334

[56] References Cited

U.S. PATENT DOCUMENTS

| | | | |
|---|---|---|---|
| 2,624,366 | 1/1953 | Pugh | 138/115 |
| 2,849,923 | 9/1958 | Cotterman | 89/16 |
| 3,004,361 | 10/1961 | Hammer | 89/16 X |
| 3,228,298 | 1/1966 | Grandy et al. | 89/16 |
| 3,261,414 | 7/1966 | Boice | 175/320 |
| 3,295,613 | 1/1967 | Anderson | 173/131 |
| 3,709,754 | 1/1973 | Medler | 138/172 X |

*Primary Examiner*—Wayne L. Shedd

*Attorney, Agent, or Firm*—Dennison, Dennison, Meserole & Pollack

[57] ABSTRACT

A composite extension rod for coupling a drilling tool and a hammer which is located outside of the drill hole and has a central tube surrounded by parallel high strength rods and an outer sheath which has coupling sleeves at its ends.

9 Claims, 8 Drawing Figures

EXTENSION ROD FOR PERCUSSIVE DRILLING TOOL

The present invention relates to a novel composite extension rod for transmitting to a mine-hole drilling tool impact produced by a percussion apparatus located outside the mine-hole.

Over many years, various methods and techniques for drilling mine-holes have been described and used requiring the transmission to the drilling tool either of a rotary movement or a translatory movement associated with a percussive and rotary action.

In the case of the drilling of mine-holes of large diameter and depth, literature relating to the subject has disclosed numerous methods, such as, rotary drilling which suffers from the considerable disadvantage of being time-consuming and costly; trepanning, in which the large-diameter tool used is driven in by repeated rotation and percussion, however, in such a method, the tool advances slowly and its cutting edge brought into contact with hard rock breaks up rapidly so that the tool has to be frequently replaced; and drilling with a mine chisel wherein the tool is driven in by a hammer of the pneumatic type, for example, the rate of the percussive blows delivered being rapid. Although this last method enables drilling to be carried out in an effective manner, it is admitted that in the working of mines, a depth of twelve meters represents a maximum that can only be exceeded with difficulty.

Drilling to a great depth such as is practiced in the existing methods is, however, directly controlled from the surface by the appropriate apparatus, which may be pneumatic or electrical, for example.

The impact delivered by the hammer is transmitted to the drilling tool by a set of coupled bars generally provided with an axial affording passage to a gaseous fluid or a liquid which is required not only for cooling the cutting tool, but also for discharging broken material formed during drilling and collecting at the inner end of the hole during its formation.

Experts in the field have found that hollow bars fitted together for drilling to a great depth suffer from some weakness and that the break either at the joint between them or at places other than these particular zones.

It is known to use rolled or drawn hollow one-piece coupling bars of round or polygonal outside contour, the screwthreaded ends of the bars being adapted to receive either coupling sleeves or the drill itself. These bars have to be manufactured with great care because of the mechanical properties necessary for ensuring that their average service life is sufficiently lengthy to be compatible with the cost of carrying out drilling. It is in fact difficult to obtain, by rolling or drawing, a coupling bar having a length of 5 or 6 meters and finally undergoing heat treatment (cementation, quenching, etc.) that has a good fatigue strength throughout so that it can withstand alternating tensile and compressive loads.

Solutions have been put forward with a view to eliminating the above-mentioned disadvantages or at least reducing them. Thus, for example, it has been proposed to position the percussive apparatus directly on the cutting tool so that said apparatus is moved into the mine-hole and lowered immediately following the tool that it actuates, as drilling proceeds.

This technique known as the "hole-bottom hammer method" has not permitted the use of powerful hammers since their size has been limited by the diameter of the drilled hole. The technique wherein to hammer is disposed outside the hole, on the other hand, has enabled very powerful machines to be used, particularly since the advent of hydraulic hammers.

This increase in the power used in drilling has forced the experts in the field to try to develop high-strength drilling rods.

For this reason and because of all of the above-mentioned disadvantages, the present applicant has carried out research in this field and has developed a novel composite extension rod which provides a reliable solution to the difficulties encountered by the experts.

The novel composite extension rod which is for coupling the drilling tool and the hammer located outside the hole for drilling operations carried out in all directions in underground and open-mining work is characterized in that it consists of a central tube around which are arranged rods of high mechanical strength, the assembly consisting of said tube and rods having an outer sheath and being provided at its ends with coupling sleeves.

The invention will be understood more clearly from the following description which refers to the annexed drawings which are not intended to limit the scope of the invention.

Figure 1:
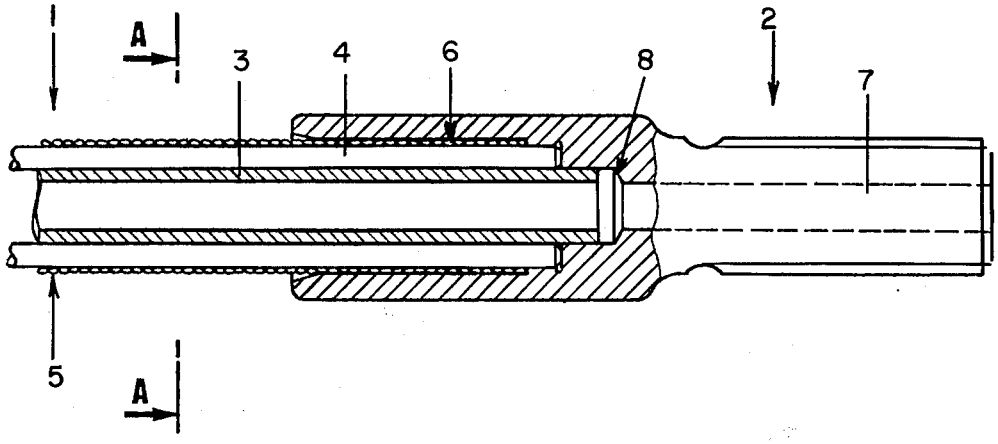
FIG. 1 is a longitudinal section in the zone nearest a coupling.
Figure 2:
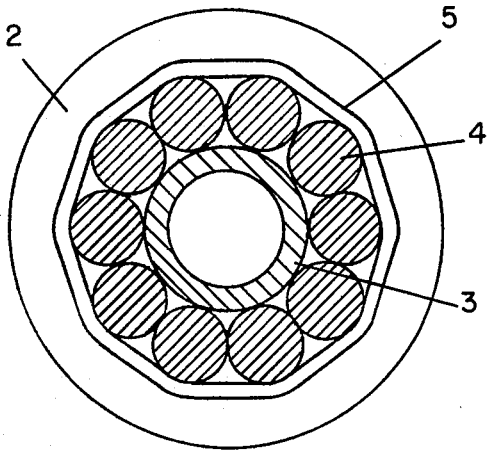
FIG. 2 is a cross-section on the line AA of FIG. 1 through the composite extension rod.

Referring to FIG. 1, the extension rod in accordance with the invention consists of a bar element 1, provided at each of its ends with suitable connecting means 2.

The bar element shown generally at 1 consists of a tube 3, elongate solid rods 4 and a sheath 5 for holding the tube 3 and the set of rods 4 together. The tube 3, the cross-section of which may be circular, eliptical or polygonal, and which may have a plain, fluted or serrated outer surface, enables a drilling fluid to pass to the inner end of the hole and thus to perform two essential functions which are the cooling of the drilling tool and the discharge of broken pieces of material occuring during drilling.

Figure 3:
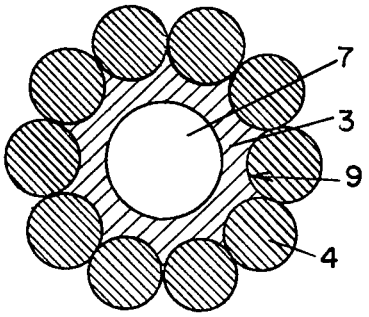
FIG. 3 illustrates a section similar to FIG. 2 of a modified combination consisting of a central tube having a fluted exterior and solid cylindrical rods.
Figure 4:
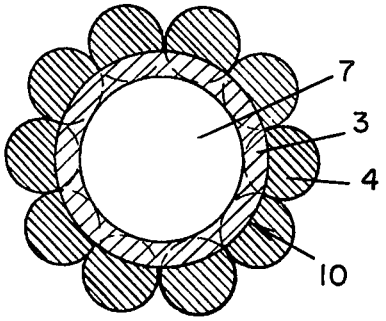
FIG. 4 is a section through a further modified combination consisting of a central tube of the cylindrical type and of solid rods having a crescent-shaped cross-section, the concave surface of which mates with the outer surface of the central tube.

In particular, FIG. 3 illustrates a tube 3 having a fluted outer surface, each flute 9 providing a seat for a cylindrical rod 4 so that a self-locking arrangement is created. In another variation, illustrated in FIG. 4, the tube 3 has a plain rounded surface and the solid rods 4 have a crescent-shaped cross-section, the concave curved face 10 of which is in intimate contact with said tube 3.

Figure 5:
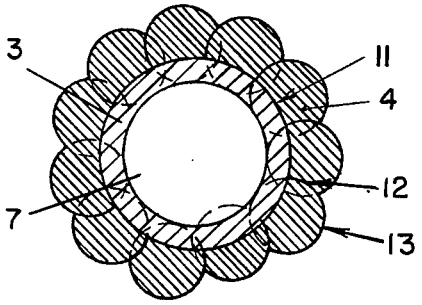
FIG. 5 is a section through another modified combination consisting of a central tube of the cylindrical type and of solid rods having a truncated crescent-shaped cross-section.

FIG. 5 illustrates yet another variation which uses a tube 3 having a plain curved wall and solid rods 4 of truncated crescent-shaped cross-section such that the concave curved face 11 is in intimate contact with the wall of the tube 3, whereas the curved face 12 of the truncated portion is in intimate contact with parts of the curved convex face 13 of the adjacent rod.

Figure 6:
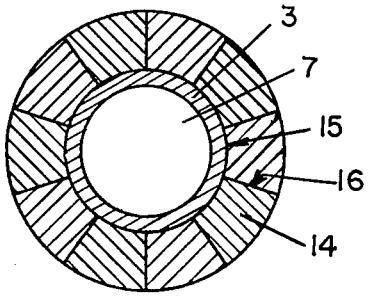
FIG. 6 shows a section through yet another combination consisting of a central cylindrical tube and of solid rods having a trapezoidal cross-section with curved bases.

FIG. 6 shows an assembly consisting of a tube 3 having a plain curved wall and solid rods 14 of trapezoidal cross-section with curved bases, the arrangement being such that the small curved base 15 is in intimate contact with the outer wall of said tube 3, whereas each of the lateral faces 16 of each rod lies flush against that of the adjacent rod.

Figure 7:
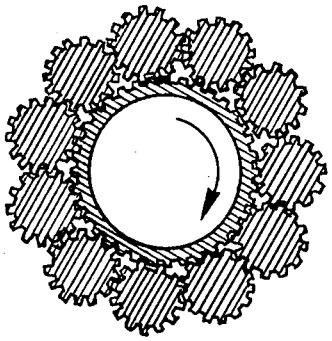
FIG. 7 is a sectional view of a combination consisting of a central tube of the cylindrical type and having a serrated outer wall and solid rods of the cylindrical type, the outer walls of which are likewise serrated.
Figure 8:
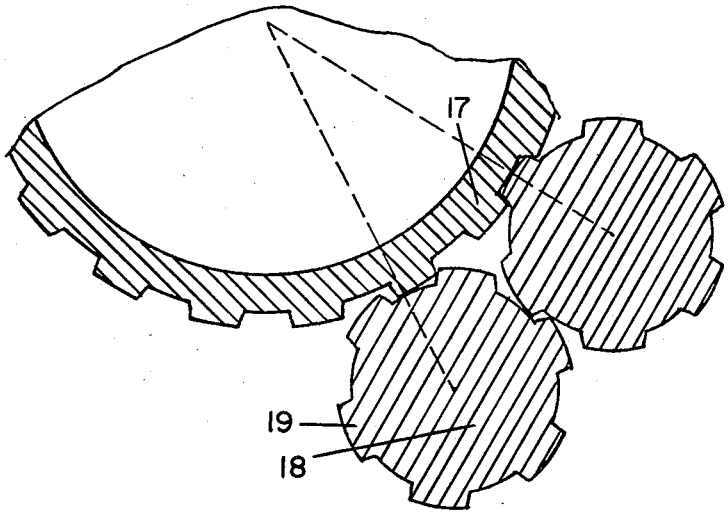
FIG. 8 is a larger scale view of a portion of FIG. 7 and shows how two solid rods fit into the central tube.

FIGS. 7 and 8 illustrate an arrangement comprising a tube 3 having an indented, e.g. scalloped, serrated, channelled, etc. outer wall 17 and solid rods 18 having an outer indented wall 19, each projecting portion of which is adapted to fit into a recessed portion.

The central tube can be made of any one of a large number of different materials capable of providing a physical condition ranging from rigid to flexible. Thus, such a tube may be made of metal, but it may also consist of flexible tubing of polymeric material reinforced by metallic elements, for example, a flexible sheath, netting, etc. or reinforced with textile products such as high-strength synthetic fibers and glass fibers. Alternatively, the tube may be made from more elaborate products such as lattice structures in molded polymeric material, woven cloths and non-woven cloths so that the tube is able to carry in a fluid-tight manner the fluid for cooling the drilling tool and for discharging the residue resulting from drilling.

The solid elongate rods, the cross-section of which may be circular, eliptical, polygonal, crescent-shaped or in the form of a truncated crescent and the outer surface of which may be plain or serrated, perform the function of transmitting the blows delivered by the percussion apparatus to the drilling tool in contact with the inner end of the hole that is to be formed.

These rods may be made of various materials such as metals, high-strength polymers, optionally reinforced, glass-fibers and certain synthetic fibers bonded together by high-strength resins.

These rods can be easily produced by methods well known to the art, such as for example by rolling, drawing, extrusion or molding, and they therefore have sufficiently good mechanical properties to enable them to resist fatigue, these mechanical properties being much superior to those of the hollow one-piece coupling bars normally used for drilling operations in which the hammer is located outside the hole.

Depending upon the cross-section of the central tube and of the solid rods, it is possible to obtain composite extension rods that have a more or less great resistance to torsion.

Thus, for example, when torque is transmitted, the rods are subjected to a torsion effect which may cause them to tend to become loosened to some extent. Then, a structure such as that illustrated in FIGS. 2 to 8 prevents relative displacement between the solid rods on the one hand and the central tube on the other, and such structure provides a composite extension rod of a very uniform nature which completely resists all deformation.

The sheath 5 ensures that the tube 3 and the set of rods 4 are held together. It may be made from a metallic material or a high-strength polymeric material and it may be constructed in the form of a metallic net or it may take the form of a small-diameter wrapped wire of round or polygonal cross-section, which wire may be smooth or twisted though it may also take the form of a wrapped and twisted cable.

Generally, the tube 3 will be of a length greater than that of the rods 4, but in certain special applications, these lengths may be the same.

The coupling means 2, familiar to the expert and readily produced by the conventional machining and heat-treatment methods, is a component of small length having a socket 6 which fits over the end of the composite extension rod 1. Said coupling means includes a tubular portion 7 of the same diameter as the tube 3 to enable the drilling fluid to pass through the several extension rods, and it may also be provided with sealing element 8 for establishing a seal between the tube 3 and the tubular portion 7.

The coupling means 2 is generally secured to the end of the composite extension rod 1 by a suitable method such as brazing, bonding, mechanical crimping or any other process particularly wellsuited to this system of jointing.

However, it may be advantageous to fit between the coupling means 2 and the composite extension rod 1 a sleeve made of a synthetic material, such as for example, synthetic rubber, neoprene, polyurethane, polyamides, polyvinyl chloride, the main property required of the sleeve being that whereby it damps down transverse vibrations in the assembly and reduces the noise caused by these vibrations.

The percussive apparatus being located outside the drillhole, the impacts are transmitted to the drill through the set of rods 4, whereas the drilling fluid is passed through the tube 3 which, in accordance with the invention, may have a much greater inside diameter so that it becomes possible to reduce considerably the loss of pressure of said drilling fluid.

Thus, whatever the type of percussive hammer located outside the hole, evacuation of rubble is greatly facilitated by the increase in the volume of the drilling fluid introduced, however great the depth of the hole, whereas the composite extension rods run no risk of breaking under the percussive force which is distributed throughout the solid rods 4 forming the set.

The extension rod in accordance with the invention is particularly well suited for use in modern drilling techniques wherein use is made of a hydraulic or pneumatic hammer mounted on a slide which in turn either alone or together with one or more similar slides is mounted on a self-propelled carriage, the entire arrangement forming a machine generally known by the name "Jumbo" drilling equipment and currently used for digging galleries and tunnels.

I claim:

1. A composite extension rod for interconnecting a drilling tool and a percussion means, said extension rod comprising:

a. a central tube, said tube being hollow throughout to allow flow of cooling fluid, b. a plurality of elongated parallel high strength rods of a cross-section smaller than said tube arranged about the periphery of said tube, each rod being in contact with the next adjacent parallel rod, c. an outer sheath covering said parallel rods and holding said rods against said tube, and d. coupling means secured to said rod on each end for connection to said drilling tool and percussion means respectively.

2. A composite extension rod as defined in claim 1 wherein said central tube and said parallel rods are cylindrical in cross-section.

3. A composite extension rod as defined in claim 1 wherein said central tube is cylindrical in cross-section and said parallel rods are polygonal in cross-section.

4. A composite extension rod as defined in claim 1 wherein said central tube is provided with a plurality of semicircular longitudinal flutes along its outer length, said plurality of parallel rods being received in said flutes .

5. A composite extension rod as defined in claim 1 wherein each of said parallel rods and central tube are provided along their surfaces with gear-like serration means in interengagement with each other.

6. A composite extension rod as defined in claim 1 wherein said central tube is formed of metal.

7. A composite extension rod as defined in claim 1 wherein said central tube is formed of a flexible polymeric material.

8. A composite extension rod as defined in claim 1 wherein said parallel rods are formed of metal.

9. A composite extension rod as defined in claim 1 wherein said parallel rods are formed of a high-strength polymer.

* * * * *